US005384206A

United States Patent [19]

Ushioda et al.

[11] Patent Number: 5,384,206

[45] Date of Patent: Jan. 24, 1995

[54] HIGH-STRENGTH COLD-ROLLED STEEL STRIP AND MOLTEN ZINC-PLATED HIGH-STRENGTH COLD-ROLLED STEEL STRIP HAVING GOOD FORMABILITY AND METHOD OF PRODUCING SUCH STRIPS

[75] Inventors: Kohsaku Ushioda; Naoki Yoshinaga; Osamu Akisue, all of Futtsu, Japan

[73] Assignee: Nippon Steel Corporation, Tokyo, Japan

[21] Appl. No.: 117,042

[22] PCT Filed: Mar. 13, 1992

[86] PCT No.: PCT/JP92/00304

§ 371 Date: Sep. 3, 1993

§ 102(e) Date: Sep. 3, 1993

[87] PCT Pub. No.: WO92/16668

PCT Pub. Date: Jan. 10, 1992

[30] Foreign Application Priority Data

Mar. 15, 1991 [JP] Japan ..... 3-074201
Jun. 12, 1991 [JP] Japan ..... 3-140481

[51] Int. Cl.[6] ..... B32B 15/18; C21D 7/02; C21D 9/52

[52] U.S. Cl. ..... 428/659; 148/533; 148/537; 148/320; 148/333; 148/651

[58] Field of Search ..... 428/659; 148/533, 537, 148/320, 333, 651

[56] References Cited

U.S. PATENT DOCUMENTS

| | | | |
|---|---|---|---|
| 4,473,414 | 9/1984 | Irie et al. | 425/659 |
| 4,878,960 | 11/1989 | Sakai et al. | 148/533 |
| 5,019,460 | 5/1991 | Yasuda et al. | 428/659 |
| 5,069,981 | 12/1991 | Oishi et al. | 428/659 |
| 5,156,690 | 10/1992 | Asano et al. | 428/659 |

FOREIGN PATENT DOCUMENTS

| | | | |
|---|---|---|---|
| 122820 | 9/1980 | Japan . | |
| 55-122821 | 9/1980 | Japan . | |
| 55-125235 | 9/1980 | Japan . | |
| 56-139654 | 10/1981 | Japan . | |
| 56-142852 | 11/1981 | Japan . | |
| 57-41349 | 3/1982 | Japan . | |
| 57-181361 | 11/1982 | Japan . | |
| 58-25436 | 2/1983 | Japan . | |
| 59-31827 | 2/1984 | Japan . | |
| 59-38337 | 3/1984 | Japan . | |
| 59-74232 | 4/1984 | Japan | 148/533 |
| 63-190141 | 8/1988 | Japan . | |
| 1-62440 | 3/1989 | Japan . | |
| 1-75650 | 3/1989 | Japan . | |
| 1-123058 | 5/1989 | Japan | 148/533 |
| 2111841 | 4/1990 | Japan . | |
| 3-180429 | 8/1991 | Japan | 148/533 |
| 3-281732 | 12/1991 | Japan | 148/533 |
| 3-294463 | 12/1991 | Japan | 148/533 |

OTHER PUBLICATIONS

Takechi, Recent Developments in Production Technology of Automotive High Strength Steel Sheets, Iron and Steel, 1982, No. 9, pp. 116–129.

*Primary Examiner*—John Zimmerman
*Attorney, Agent, or Firm*—Pollock, Vande Sande & Priddy

[57] ABSTRACT

A high-strength cold-rolled steel strip or a molten zinc-plated high-strength cold-rolled steel strip which have a low yield strength, containing, by weight, of 0.0005–0.01% C, not more than 0.8% Si, more than 0.5% but not more than 3.0% Mn, 0.01–0.12%: P. 0.0010–0.015% S, 0.01–0.1% Al, 0.0005–0.0060% N, not less than 0.0001% but less than 0.005–0.1% the content of Nb being made to satisfy Nb ≧93/12 (C-0.0015), or instead of 0.005–0.1% Nb, 0.0005–0.1% Ti and 0.003–0.1% Nb, the content of Nb and the content of Ti being made satisfy, Ti≧3.42N, and the balance Fe and incidental impurities is provided. Another steel strip or molten zinc-plated strip is provided that contains 0.2–3.0% Cr but does not require B, and includes both Ti and Nb. The method of producing such is also provided.

15 Claims, 1 Drawing Sheet

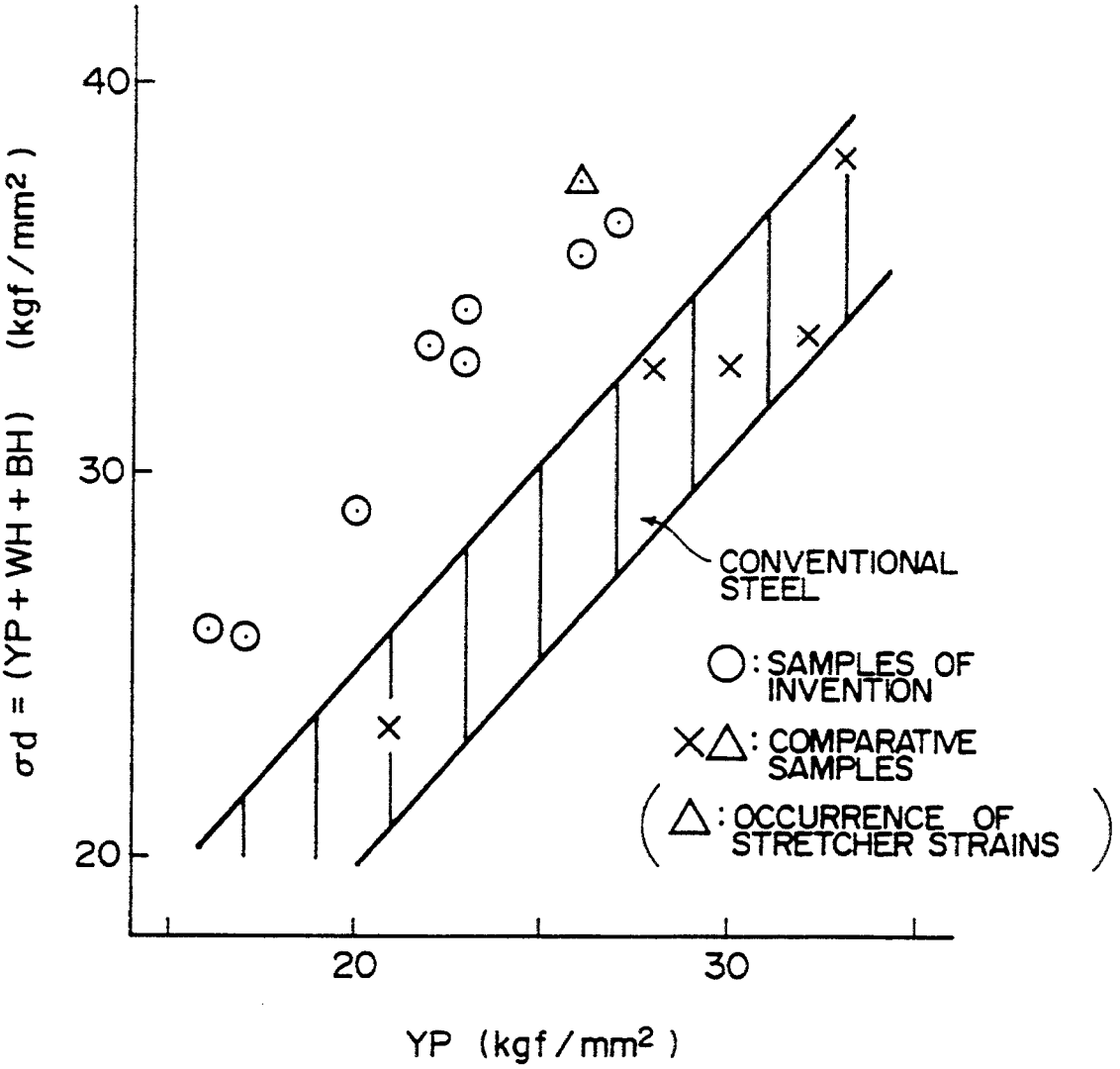
40
30
20
σd = (YP + WH + BH) (kgf / mm²)
20
30
YP (kgf / mm²)
CONVENTIONAL STEEL
○: SAMPLES OF INVENTION
×△: COMPARATIVE SAMPLES
(△: OCCURRENCE OF STRETCHER STRAINS)

HIGH-STRENGTH COLD-ROLLED STEEL STRIP AND MOLTEN ZINC-PLATED HIGH-STRENGTH COLD-ROLLED STEEL STRIP HAVING GOOD FORMABILITY AND METHOD OF PRODUCING SUCH STRIPS

TECHNICAL FIELD

This invention relates to a cold-rolled steel strip having a high strength and a good formability, and also to a method of producing the same.

A high-strength cold-rolled steel strip with which the present invention is concerned is press-formed for use in an automobile, electronic home appliances, a building, and so on. Such strip includes both a cold-rolled steel strip with no surface treatment in a narrow sense and a cold-rolled steel strip with a surface treatment such, for example, as Zn-plating and alloyed Zn-plating, for rust prevention purposes. A steel strip according to the present invention is one having both strength and workability, and therefore when this strip is to be used, it can be made smaller in thickness than conventional steel strips, and hence can be lightweight. Therefore, it is thought that it can contribute to the protection of the environment of the earth.

BACKGROUND ART

With the recent progress of a vacuum degassing treatment of molten steel, it has now become easy to make very low-carbon steel through melting, and there has now been an increasing demand for very low-carbon steel strips having a good workability. Among such strips, a very low-carbon steel strip, having Ti and Nb added thereto in combination, which is disclosed for example in Japanese Patent Unexamined Publication No. 59-31827 and Japanese Patent Unexamined Publication No. 59-38337, possesses a very good workability, also has coating-baking hardenability (BH), and is excellent in molten zinc platability, and therefore is now holding an important position.

On the other hand, in order to enhance the strength while maintaining the workability, various attempts have heretofore been made. Particularly, in the case of steel with a tensile strength of 35 to 50 kgf/mm$^2$ with which the present invention is concerned, P, Si and so on have been added to the steel to increase the strength utilizing a solid solution-strengthening mechanism thereof. For example, Japanese Patent Unexamined Publication No. 59-31827 and Japanese Patent Unexamined Publication No. 59-38337 disclose a method of producing a high-strength cold-rolled steel strip in which Si and P are mainly added to a very low-carbon steel strip having Ti and Nb added thereto, thereby increasing the tensile strength up to the 45 kgf/mm$^2$ class. Japanese Patent Publication No. 57-57945 discloses a representative prior art technique relating to a method of producing a high-strength cold-rolled steel strip in which P is added to Ti-added, very low-carbon steel. Japanese Patent Unexamined Publication No. 56-139654 discloses a high-strength steel strip based on Nb-added, very low-carbon steel, as well as a method of producing the same.

As described above, P and then Si have heretofore been extensively used as a strengthening element. This is because it has been thought that by adding a small amount of P and Si, the strength can be increased since they have a very high solid solution-strengthening ability, that ductility and deep drawability are not so lowered, and that the cost of the addition is not so increased. Actually, however, when it is intended to achieve the increase of the strength only with these elements, not only the strength but also a yield strength are simultaneously increased markedly, so that a defect in plane shape occurs, and its use for a panel of an automobile is sometimes limited. In the case of applying molten zinc-plating, Si causes a plating defect, and also P and Si greatly lowers the alloying speed, which results in a problem that the productivity is lowered.

On the other hand, it is also known to use Mn and Cr as a solid solution-strengthening element. Japanese Patent Unexamined Publication No. 63-190141 and Japanese Patent Unexamined Publication No. 64-62440 disclose a technique in which Mn is added to a Ti-contained, very low-carbon steel strip, and Japanese Patent Publication No. 59-42742 and the above-mentioned Japanese Patent Publication No. 57-57945 disclose a technique in which Mn and Cr are added to Ti-added, very low-carbon steel; however, (i) the addition of Mn or Cr merely plays an auxiliary role for the main addition elements, P and Si, and therefore the obtained cold-rolled steel strip is high in yield strength as compared with the strength, and besides (ii) they are not added positively for other purposes than the above purpose (i), such as (a) the purpose of enhancing a work hardening rate, (b) the purpose of imparting a BH property, (c) the purpose of enhancing a secondary workability and (d) the purpose of improving the platability of molten zinc-plating.

Further, Japanese Patent Unexamined Publication No. 2-111841 discloses a cold-rolled steel strip and a molten zinc-plated steel strip having a good workability and a baking hardenability in which not less than 1.5% but less than 3.5% Mn is added to very low-carbon steel having Ti added thereto. With the addition of a large amount of Mn, the purpose is to achieve a stable operation of hot rolling due to a lowered $Ar_3$ transformation point, as well as the uniformity of the metal structure. For the purpose of further enhancing the ductility, the addition of Cr or V of up to 0.2 to 1.0% is also disclosed. However, there is no description from the viewpoint that the addition of a large amount of Mn or Cr improves mechanical properties, and particularly a balance between the strength and the ductility. Furthermore, the amount of addition of Si is determined to be not more than 0.03% in view of a secondary workability, a chemical conversion treatability and a plating adherability. However, Si is an effective solid solution-strengthening element, and in fact it can be added in an amount of more than 0.03% without substantial detriment to such properties.

A steel strip used for a panel of an automobile or the like is strictly required to have a good plane shape in which there occurs neither spring back nor plane strain after the pressing. Incidentally, it is well known that the lower the yield strength is, the better the plane shape is. However, as described in connection with the prior art, generally, the high-strength design of a steel strip involves an extreme increase in yield strength. Therefore, it is necessary to increase the strength while restraining the increase of the yield strength as much as possible.

Furthermore, a steel strip after subjected to press-forming is required to have a dent-preventing property. The dent-preventing property means a resistance of the steel strip to a permanent dent deformation occurring when a stone or the like strikes against an assembled automobile. Where the strip thickness is uniform, the higher a deformation stress after the press forming and the coating baking is, the better the dent-preventing property is. Therefore, in the case where a steel strip have the same yield strength, the higher a work hardenability is in a low strain range, and also the higher the coating-baking hardenability is, the more the dent-preventing property is enhanced.

From the foregoing, a desirable high-strength steel strip used for a panel of an automobile or the like is not so high in yield strength, and is extremely work-hardened, and if possible, has a coating-baking hardenability. Of course, it also need to be excellent in such workability as the average r value (deep drawability) and elongation (bulging property), and further need to be substantially of a non-aging nature at normal temperatures.

DISCLOSURE OF THE INVENTION

The present invention is to meet these requirements, and an object of the invention is to provide a high-strength cold-rolled steel strip which has a tensile strength of 35~50 kgf/mm$^2$, a yield strength of 15~28 kgf/mm$^2$, and a WH amount (2% deformation stress yield—yield strength) of not less than 4 kgf/mm$^2$, which is an index of work hardenability in a low strain range, and can have a BH property of not less than 2 kgf/mm$^2$ if necessary, and is good in the average r value and elongation, and hardly causes a secondary working embrittlement, and further can have a good molten zinc-platability if necessary, the object also providing a method of producing such a strip.

In order to achieve the above object, the inventors of the present invention have made an earnest study and obtained the following findings.

Namely, using as a base very low-carbon steel having Nb added thereto or having Ti and Nb added in combination thereto, representative solid solution-strengthening elements, Si, P, Mn and Cr, were added thereto, and a tensile property and particularly a yield strength and a work hardening phenomenon after cold-rolling, annealing and temper rolling were examined in detail. As a result, it has been found (a) that Si and P heretofore extensively used as a solid solution-strengthening element, when added in a trace amount, markedly increases the yield strength, and (b) that as a result a work hardening rate is markedly decreased in a low strain range.

On the other hand, there has been obtained a new, very important finding that when Mn and Cr which have not heretofore been much used as a solid solution-strengthening element are added, (a) the yield strength hardly increases whereas the tensile strength increases, and (c) as a result the work hardening rate in a low strain range rather increases with the addition of these elements.

As a result of studying these mechanisms, there have been created fundamental principles (a) that the yield strength is determined by the difference in atomic radius between Fe element and the added X element, and the larger the difference of the atomic radius is, the more the yield strength increases, (b) that the work hardening rate is closely related to the behavior of slippage of the dislocation, and when the stacking fault energy decreases with the addition of the X element, the cross slippage of the dislocation becomes difficult, so that the dislocation density increases, thereby increasing the work hardening rate. According to this, it can be understood that since Si and P are far smaller in atomic radius than Fe, the atomic radius difference becomes large, so that the yield strength greatly increases, and that since Mn and Cr are quite close in atomic radius to Fe, the yield strength hardly changes.

On the other hand, the influence on the stacking fault energy related to the work hardening rate is not entirely clear, however, as a result of detailed observation of the dislocation structure after the initial work hardening by an electronic microscope, it has become clear for the first time that Si and P hardly give an influence to the stacking fault energy in the range of the addition amount surveyed whereas Mn and Cr tend to lower it.

It is thought from the above mechanisms that when Mn and/or Cr is added, the yield strength hardly changes whereas the work hardening rate increases to increase the tensile strength. In order to achieve the above-mentioned object of the present invention, such characteristic behavior means that the addition of Mn and/or Cr is preferable to the addition of Si and P heretofore used. Therefore, in the present invention, a positive use of Mn and/or Cr is a basic solution means for the prior art. However, only with the addition of Mn and/or Cr, there are encountered cases where the desired strength is not obtained and where the production cost increases, and therefore the addition of Si and P in combination therewith is also taken into consideration.

Further, the inventors of the present invention have also obtained a new finding that a positive addition of Mn and/or Cr also enhances the BH property. This is thought to be due to the fact that since these elements have a mutual action with C in attractive force, and therefore more stabilize C in the solid solution state in a matrix which C is equilibrated with TiC or NbC, a solubility product thereof becomes large, so that C is again solid-solutioned during the annealing with the result that the amount of the residual C in the solid solution state increases. Therefore, the addition of Mn and/or Cr can also be positively used as a new means for imparting the BH property. Like B, C in the solid solution state which imparts the BH property is also effective as means for preventing a secondary working embrittlement which is known as a drawback of very low-carbon steel.

Further, the inventors of the present invention have also obtained a new finding that the steel of the present invention, in which Mn and/or Cr are positively used while restraining the amount of addition of Si and P which have been much used as a strengthening element in the conventional steel, has the following advantages in the production of an alloyed, molten zinc-plated steel strip particularly by a continuous molten zinc plating process of a Zendimir type. Namely, Si and P restrain an alloying reaction between Zn and Fe, and therefore when producing a steel strip containing a large amount of these elements, the line speed had to be lowered to reduce the productivity. Furthermore, the addition of Si deteriorates the plating adherability, and have caused various problems during the press forming. On the other hand, it has been found that the addition of Mn and Cr does not invite such adverse effects. This also has been positively used as means for solving the problems of the conventional methods.

The present invention has been created based on such idea and new findings, and the subject matter which have a low yield strength, excellent work hardenability, excellent baking hardenability, average r value not less than 1.6, and excellent formability, consisting, by weight, of 0.0005–0.01% C, not more than 0.8% Si, more than 0.5% but not more than 3.0% Mn, 0.01~0.12% P, 0.0010~0.015% S, 0.01~0.1% Al, 0.0005~0.0060% N, not less than 0.0001% but less than 0.0005% B, the contents of B and N being made to satisfy B/N ≦0.48, 0.005~0.1% Nb, the content of Nb being made to satisfy Nb ≧93/12 (C-0.0015), and the balance Fe and incidental impurities.

(2) A high-strength cold-rolled steel strip and a molten zinc-plated high-strength cold-rolled steel strip set forth in claim 1 containing 0.2~3.0% Cr.

(3) A high-strength cold-rolled steel strip and a molten zinc-plated high-strength cold-rolled steel strip which have a low yield strength, excellent work hardenability, excellent baking hardenability, average r value not less than 1.6, and excellent formability, consisting, by weight, of 0.0005–0.01% C, more than 0.03% but not more than 0.8% Si, more than 0.5% but not more than 3.0% Mn, 0.01~0.12% P, 0.0010~0.015% S, 0.01~0.1% Al, 0.0005~0.0060% N, not less than 0.0001% but less than 0.0005% B, the contents of B and N being made to satisfy B/N ≦0/48, 0.005~0.1% Ti, 0.003~0.1% Nb, the content of Nb and the content of Ti being made to satisfy Ti ≧3.42N, and the balance Fe and incidental impurities.

(4) A high-strength cold-rolled steel strip and a molten zinc-plated high-strength cold-rolled steel strip which have a low yield strength, excellent work hardenability, excellent baking hardenability average r value not less than 1.6, and excellent formability, consisting, by weight, of 0.0005–0.01% C, more than 0.03% but not more than 0.8% Si, more than 0.5% but not more than 3.0% Mn, 0.2~3.0% Cr, 0.01~0.12% P, 0.0010~0.015% s, 0.01~0.1% Al, 0.0005~0.0060% N, 0.005~0.1% Ti, 0.003~0.1% Nb, the content of Nb and the content of Ti being made to satisfy Ti ≧3.42N, and the balance Fe and incidental impurities.

(5) A high-strength cold-rolled steel strip and a molten zinc-plated high-strength cold-rolled steel strip according to claim 4, containing 0.0001~0.0020% B.

(6) A method of producing a high-strength cold-rolled steel strip characterized by comprising the steps of finishing the hot-rolling of a slab, having a chemical composition as claimed in any one of claims 1 to 5, at a temperature of not less than ($Ar_3$—100)° C.; taking it up at a temperature ranging from room temperature to 750° C.; cold-rolling it at a rolling rate of not less than 60%; and annealing continuously the cold-rolled strip at an appealing temperature of 700°~900° C.

(7) A method of producing a molten zinc-plated high-strength cold-rolled steel strip having excellent anti-powdering property, characterized by comprising the steps of finishing the hot-rolling of a slab, having a chemical composition as claimed in any one of claims 1 to 5, at a temperature of not less than ($Ar_3$—100)° C.; coiling it up at a temperature ranging from room temperature to 750° C.; cold-rolling it at a rolling rate of not less than 60%; and applying thereto molten zinc-plating of an in-line annealing type at an annealing temperature of 700°~900° C.

The reasons why the steel composition and the production conditions should be limited as described above in the present invention will now be described.

The reasons why the steel composition and the production conditions should be limited as described above in the present invention will now be described further.

C: C is a very important element which determines the properties of the material of the product. In the present invention, the use of very low-carbon steel subjected to a vacuum degassing treatment is a requirement. If the C content is less than 0.0005%, the grain boundary strength decreases, so that a secondary working embrittlement develops, and also the production cost increases greatly. Therefore, its lower limit is decided to be 0.0005%. In contrast, if the C content is more than 0.01%, the formability is greatly lowered though the strength increases, and therefore its upper limit is decided to be 0.01%.

Si: Si is known as an element which increases the strength at low costs. Its addition amount varies depending on a target strength level, and if the addition amount is more than 0.8%, the yield strength increases excessively, so that a plane strain occurs during pressing. Moreover, there are encountered problems such as lowered chemical conversion treatability, lowered molten zinc-plating adherability, and a lowered productivity due to a retarded alloying reaction. Therefore, its upper limit is decided to be 0.8%. In the case of very low-carbon steel having Ti and Nb added thereto in combination, relatively coarse TiN is precipitated, and therefore Si need to be positively used in order to achieve a high-strength structure. Therefore, its lower limit is decided to be more than 0.03%. In the case of very low-carbon steel having Nb added thereto, the lower limit is not particularly specified.

Mn: Mn is an effective solid solution-strengthening element which increases the strength without so much increasing the yield strength, and it also has the effect of imparting a baking hardenability and the effect of improving a chemical conversion treatability and the platability. Therefore, in the present invention, it is positively added. If the addition amount is not more than 0.5%, the above-mentioned effects are not conspicuous, and therefore its lower limit is decided to be more than 0.5%. In contrast, if this content is more than 3.0%, low-temperature transformation substance caused after the annealing increase, and the yield strength greatly increases, and the ductility is lowered. In addition, the average r value is also lowered, and therefore its upper limit is decided to be 3.0%.

Cr: Like Mn, Cr is also an effective element which increases the strength while hardly increasing the yield strength, and imparts a baking hardenability. Therefore, when it is intended to further increase the BH property or to achieve an increased-strength structure with a low yield strength, this element is positively used. However, in the case of utilizing Cr, if the amount of addition thereof is less than 0.2%, no effect is obtained, and therefore its lower limit value is decided to be 0.2%. In contrast, if this amount is more than 3%, a pickling property of a hot-rolled strip is lowered, and a chemical conversion treatability of the strip product is degraded. Therefore, its upper limit is decided to be 3%.

P: Like Si, P is known as an element which increases the strength at low costs, and the amount of addition thereof varies depending on a target strength level. When a tensile strength of 35~50 kgf/mm$^2$ is to be obtained as in the present invention, its addition amount is decided to be not less than 0.01%. However, if the addition amount is more than 0.12%, the yield strength increases too much, so that a defective plane shape develops during pressing. Besides, the alloying reaction is extremely retarded at the time of continuous molten zinc plating, so that the productivity is lowered. Furthermore, a secondary working embrittlement is also encountered. Therefore, its upper limit value is decided to be 0.12%.

S: It is preferred that the amount of S be small; however, if this amount is less than 0.001%, the production cost increases, and therefore this value is decided to be a lower limit. In contrast, if the amount is more than 0.015%, a large amount of MnS is precipitated to degrade the workability, and therefore this value is decided to be an upper limit.

Al: Al is used for adjusting the deoxidation and for fixing N. If this amount is less than 0.01%, the yield of addition of Ti and Nb is lowered. In contrast, if this amount is more than 0.1%, the cost is increased.

Nb: Nb serves to fix a part of or the whole of C by forming NbC, thereby ensuring a workability and a non-aging property of very low-carbon steel strip. If the Nb content is less than 0.005%, or if Nb $\leqq$93/12 (C—0.0015) occurs, the effect by its addition is not obtained. Therefore, this element is added in an amount of not less than 0.005% in such a manner as to meet Nb $\geqq$93/12 (C—0.0015).

However, when Ti and Nb are added in combination, Ti partially undertakes the role of Nb, and therefore the lower limit of Nb is decided to be 0.003%. In contrast, if the Nb content is more than 0.10%, a great increase of the alloying cost, a rise of a recrystallizing temperature, and a lowered workability are invited, and therefore its upper limit value is decided to be 0.10%.

Ti: Ti serves to fix the whole of N, or a part or the whole of C and S, thereby ensuring a workability and a non-aging property of very low-carbon steel. Ti this value is decided to be a lower limit. In contrast, if this amount is more than 0.1%, a great increase of the alloying cost is invited, and therefore its upper limit value is decided to be 0.10%.

N: It is preferred that the amount of N be small. However, if this amount is decided to be less than 0.0005%, the cost is greatly increased. In contrast, if this amount is too large, the addition of Nb and Al becomes necessary, and also the workability is degraded. Therefore, its upper limit value is decided to be 0.0060%.

B: Where N is beforehand fixed, B segregates in a crystal grain boundary, and is effective in preventing a secondary working embrittlement. Therefore, it is added in an amount of 0.0001~less than 0.0005%. If this amount is less than 0.0001%, its effect is insufficient, and if this amount is not less than 0.0005%, it causes deterioration of the workability. However, in the case where Ti and Nb are added in combination, and also Cr is contained, the workability is kept even if not less than 0.0005% of this element is added, and therefore its upper limit is decided to be 0.0020%. Further, B must be added in such a range that the contents of B and N are made to satisfy B/N $\leqq$0.48. That is, if B/N exceeds 0.48, many BN particles will precipitate to make the yield strength high together with the deterioration of elongation and r value etc. and to make it impossible to keep solid-solutioned B, with the result that it becomes impossible to keep sufficient resistance to the secondary working embrittlement.

Next, the reasons for limiting the production conditions will now be explained.

The temperature of finishing the hot-rolling need to be not less than $Ar_3$—100° C. in order to ensure conditions will now be explained.

The temperature of finishing the hot-rolling need to be not less than $Ar_3$—100° C. in order to ensure the workability of the strip product. The coiling-up temperature is decided to be in the range of between room temperature and 750° C. The present invention has a feature that the material of the product is hardly influenced by the coiling-up temperature for the hot rolling. This is thought to be attributable partly to the fact that with the addition of a considerable amount of Mn and Cr, the structure of the hot-rolled strip is quite fine and uniform in grain size. The upper limit of the coiling-up temperature is decided to be 750° C. in order to prevent the decrease of the yield due to a degradation of the material at opposite ends of the coil.

The condition of the cold rolling may be ordinary, and in order to ensure the deep drawability after the annealing, its reduction rate is decided to be not less than 60%.

The temperature of the continuous annealing or the temperature of the annealing at the continuous molten Zn-plating facilities of the in-line annealing type is decided to be 700° C.~900° C. If the annealing temperature is less than 700° C., the recrystallization is insufficient. The workability and the BH property are enhanced with a rise of the annealing temperature, but if this temperature is more than 900° C., this temperature is there is produced a high-strength cold-rolled steel strip which has a tensile strength of 35~50 kgf/mm$^2$, a yield strength of 15~28 kgf/mm$^2$, and a WH amount (2% deformation stress—yield strength) of not less than 4 kgf/mm$^2$, which is an index of work hardenability in a low strain range, and can have a BH property of not less than 2 kgf/mm$^2$ if necessary, and can have average r value not less than 1.6, and is good in elongation, and hardly causes a secondary working embrittlement, and further can have a good molten zinc-platability as occasion demands.

Next, the present invention will now be described by way of Examples.

BRIEF DESCRIPTION OF THE DRAWING

The drawing is a graph showing the relation between yield strength and $\sigma$hd d (index of dent property).

THE BEST MODE FOR CARRYING OUT THE INVENTION

[Example 1]

Steels having respective compositions shown in Table 1 were prepared through melting, and each steel was hot rolled into a steel strip with a thickness of 4.0 mm at a slab heating temperature of 1150° C., a finish temperature of 910° C., and a coiling take-up temperature of 650° C. After pickling, it was cold-rolled at a reduction rate of 80% into a cold-rolled strip with a thickness of 0.8 mm. Subsequently, the strip was of 650° C. After pickling, it was cold-rolled at a reduction rate of 80% into a cold-rolled strip with a thickness of 0.8 mm. Subsequently, the strip was subjected to continuous annealing in which a heating rate was 15° C./sec., a soaking was effected at a rate of 840° C. $\times$50 sec, and a cooling rate was 20° C./sec. Further, the strip was subjected to temper rolling at a reduction rate of 0.5%, and a JIS No. 5 tensile test piece was taken therefrom, and was subjected to a tensile test. Results of the tensile test are collectively shown in Table 2.

TABLE 1

| Steel No. | C | Si | Mn | P | S | Al | Cr | Ti | Nb | N | B | Note |
|---|---|---|---|---|---|---|---|---|---|---|---|---|
| | Chemical composition of samples (wt. %) | | | | | | | | | | | |
| 1-1 | 0.0020 | 0.033 | 0.92 | 0.02 | 0.006 | 0.04 | 0.3 | 0.012 | 0.010 | 0.0022 | — | Present invention |
| 1-2 | 0.0028 | 0.010 | 0.95 | 0.03 | 0.006 | 0.04 | — | — | 0 045 | 0.0016 | 0.0002 | Present invention |
| 1-3 | 0.0023 | 0.041 | 0.15 | 0.07 | 0.005 | 0.04 | — | 0.030 | 0.011 | 0.0018 | 0.0002 | Comparative steel |
| 2-1 | 0.0017 | 0.025 | 1.35 | 0.06 | 0.005 | 0.03 | 0.6 | — | 0.011 | 0.0020 | 0.0003 | Present invention |
| 2-2 | 0.0034 | 0.051 | 1.50 | 0.05 | 0.006 | 0.04 | — | 0.015 | 0.012 | 0.0016 | 0.0004 | Present invention |
| 2-3 | 0.0022 | 0.032 | 0.25 | 0.10 | 0.007 | 0.03 | — | 0.025 | — | 0.0020 | — | Comparative steel |
| 2-4 | 0.0030 | 0.047 | 1.10 | 0.05 | 0.007 | 0.04 | — | 0.002 | 0.004 | 0.0015 | 0.0005 | Comparative steel |
| 3-1 | 0.0019 | 0.530 | 1.80 | 0.05 | 0.007 | 0.03 | — | 0.007 | 0.025 | 0.0015 | 0.0002 | Present invention |
| 3-2 | 0.0020 | 0.140 | 1.40 | 0.07 | 0.008 | 0.04 | 1.5 | — | 0.030 | 0.0018 | 0.0004 | Present invention |
| 3-3 | 0.0030 | 0.542 | 0.30 | 0.10 | 0.005 | 0.05 | — | — | 0.070 | 0.0013 | 0.0003 | Comparative steel |
| 3-4 | 0.0026 | 0.433 | 0.20 | 0.11 | 0.006 | 0.04 | 0.2 | 0.072 | 0.020 | 0.0014 | — | Comparative steel |
| 4-1 | 0.0034 | 0.500 | 1.80 | 0.07 | 0.008 | 0.03 | 0.5 | 0.026 | 0.011 | 0.0019 | 0.0009 | Present invention |
| 4-2 | 0.0032 | 0.351 | 2.10 | 0.06 | 0.008 | 0.04 | 2.0 | — | 0.045 | 0.0018 | 0.0003 | Present invention |
| 4-3 | 0.0036 | 0.930 | 0.70 | 0.14 | 0.008 | 0.04 | — | 0.024 | 0.005 | 0.0015 | 0.0004 | Comparative steel |

TABLE 2

| Steel No. | YP | TS | EI | $\bar{r}$ | WH | BH | σd* | Embrittlement transition temperature | Note |
|---|---|---|---|---|---|---|---|---|---|
| 1-1 | 16 | 35 | 46 | 2.0 | 6.1 | 3.8 | 25.9 | −80 | Present invention |
| 1-2 | 17 | 35 | 45 | 2.1 | 5.5 | 3.2 | 25.7 | −75 | Present invention |
| 1-3 | 21 | 35 | 40 | 1.9 | 2.3 | 0.2 | 23.5 | −5 | Comparative steel |
| 2-1 | 20 | 40 | 42 | 2.0 | 5.7 | 3.3 | 29.0 | −70 | Present invention |
| 2-2 | 22 | 41 | 41 | 1.9 | 7.1 | 4.2 | 33.3 | −75 | Present invention |
| 2-3 | 28 | 40 | 36 | 1.8 | 1.5 | 3.3 | 32.8 | −70 | Comparative steel |
| 2-4 | 26 | 40 | 38 | 1.4 | 4.2 | 7.3[1)] | 37.5 | −80 | Comparative steel |
| 3-1 | 23 | 44 | 41 | 1.8 | 6.9 | 4.3 | 34.2 | −80 | Present invention |
| 3-2 | 23 | 45 | 39 | 1.9 | 6.2 | 3.6 | 32.8 | −70 | Present invention |
| 3-3 | 32 | 46 | 33 | 1.6 | 1.4 | 0.2 | 33.6 | 0 | Comparative steel |
| 3-4 | 30 | 45 | 31 | 1.5 | 2.8 | 0.1 | 32.9 | 15 | Comparative steel |
| 4-1 | 27 | 50 | 37 | 1.7 | 5.4 | 4.1 | 36.5 | −75 | Present invention |
| 4-2 | 26 | 51 | 36 | 1.6 | 6.6 | 3.0 | 35.6 | −70 | Present invention |
| 4-3 | 33 | 49 | 31 | 1.5 | 1.8 | 3.5 | 38.3 | −60 | Comparative steel |

*σd = YP + BH + WH

[1)]Because of Ti < 3.42N, when the strip product is subjected to artificial aging at 100° C. for 1 hour, elongation of 1.2% at a yield point occurs, and this causes stretcher-strain during pressing.

Here, the WH amount which is important in the present invention is the amount of work hardening occurring when applying a tensile strain of 2% in the rolling direction, and is a value obtained by subtracting a yield stress (YP) from a 2% deformation stress. The BH amount is also an amount of increase of a stress (a value obtained by subtracting the 2% deformation stress from a lower yield stress when the tensile test was conducted again) obtained when a 2% prestrained material was subjected to a heat treatment corresponding to a coating baking of 170° C. ×20 min. and then was again subjected to a tensile test. A secondary working embrittlement transition temperature is a ductility-embrittlement transition temperature obtained when a drop-weight test was applied at various temperatures to a cup which was formed by stamping a blank with a diameter of 50 mm from a steel strip subjected to temper rolling and then by forming it into a cup-shape by a punch having a diameter of 33 mm.

As is clear from Table 2, as compared with conventional steels subjected to a tensile test of the same level, steels of the present invention have a low yield strength and a good plane shape, and are high in the WH amount and the BH amount, and therefore are suitable for exterior and interior panels of an automobile. Namely, it is expected that as compared with the conventional steels, the steels of the present invention are low in yield strength, and is good in plane shape after the pressing even if they have the same tensile strength as that of the conventional steels.

On the other hand, as shown in FIG. 1, as compared with the conventional steels, the steels of the present invention are high in the (WH+BH) amount even if they have the same yield strength as that of the conventional steels, and therefore the dent-preventing property ($\sigma_d$=YP+WH+BH) is improved at the same time.

Furthermore, as shown in Table 2, as compared with the conventional steels, the steels of the present invention are smaller in the amount of addition of P and Si, and are much larger in the amount of addition of Mn and Cr, and therefore have a larger BH amount, and is superior in secondary working embrittlement resistance. Steel No. 2–4, when subjected to artificial aging at 100° C. for 1 hour, caused yield point elongation of 1.2% (YP-E1), which will invites stretcher-strain.

[Example 2]

Steel Nos. 1-1, 1-2, 1-3, 2-1, 2-2 and 2-3 having their respective compositions shown in Table 1 were prepared through melting, and each steel was hot rolled into a steel strip with a thickness of 4.0 mm at a slab heating temperature of 1150° C., a finish temperature of 900° C., and a coiling-up temperature of 500° C. After pickling, it was cold-rolled at a reduction rate of 80% into a cold-rolled strip with a thickness of 0.8 mm. Subsequently, it was heated to a maximum temperature of 820° C. at a heating rate of 15° C./sec., and then was cooled at a rate of about 10° C./sec., and was subjected to conventionally used molten zinc plating (the Al concentration in a bath was 0.11%). It was further heated, and was subjected to an alloying treatment at 520° C. for 20 seconds, and then was cooled to room temperature at a rate of about 10° C./sec. With respect to the alloyed, molten zinc-plated steel strips thus obtained, mechanical properties, the plating adherability and the Fe concentration in the plating film were measured. Results of these are collectively shown in Table 3.

TABLE 3

| Steel No. | YP | TS | EI | $\bar{r}$ | WH | BH | σd* | Powdering | Fe concentration % | Note |
|---|---|---|---|---|---|---|---|---|---|---|
| 1-1 | 17 | 37 | 43 | 2.0 | 6.0 | 3.5 | 26.5 | 5 | 10 | Present invention |
| 1-2 | 19 | 36 | 42 | 2.0 | 5.7 | 2.9 | 27.6 | 5 | 9.6 | Present invention |
| 1-3 | 23 | 37 | 40 | 1.8 | 2.0 | 0.1 | 25.0 | 3 | 3.2 | Comparative steel |
| 2-1 | 22 | 42 | 39 | 1.9 | 5.5 | 3.0 | 30.5 | 5 | 9.6 | Present invention |
| 2-2 | 23 | 42 | 39 | 1.8 | 6.6 | 3.9 | 33.5 | 5 | 8.8 | Present invention |
| 2-3 | 30 | 43 | 35 | 1.7 | 1.3 | 2.8 | 34.1 | 2 | 2.6 | Comparative steel |

*σd = YP + BH + WH

Here, the plating adherability was evaluated in a manner in which the strip was bent through 180° C. to be contacted with itself, and in order to determine the condition of separation of the zinc film, a cellophane adhesive tape was bonded to the bend portion, and then was peeled therefrom, thereby judging the plating adherability from the amount of separation of the plating. The evaluation was made in terms of the following 5 ranks:

1 . . . large separation, 2 . . . medium separation, 3 . . . small separation, 4 . . . very small separation, 5 . . . no separation at all.

The Fe concentration in the plating layer was found by X-ray diffraction.

As is clear from Table 3, as compared with the conventional steels, the steels of the present invention are low in YP, and are high in the WH amount and the BH amount, and $\sigma_d$ corresponding to the dent-preventing property is enhanced. This has been confirmed also in Example 1. Furthermore, as compared with the conventional steels, the steels of the present invention is good in plating adherability, and the Fe concentration in the alloy layer is at a level corresponding to that of the $\delta_i$ phase which is thought to be a desirable phase. This is thought to be due to the fact that Mn and Cr are added to increase the strength while reducing, as much as possible, the amount of Si deteriorating the plating adherability, and the amount of P and Si restraining the alloying reaction.

CAPABILITY OF INDUSTRIAL USE

As is clear from the above description, according to the present invention, the high-strength cold-rolled strip excellent in press formability which has not heretofore been achieved can be obtained by the low-cost production method. Moreover, the steel of the present invention is good in molten zinc platability, and can perform a rust prevention function. As a result, when the steel of the present invention is used for a body or a frame of an automobile, the thickness of the sheet and hence the weight of the car body can be reduced, and therefore the present invention can greatly contribute to the protection of the global environment recently drawing much interest and concern. Thus, the present invention is very significant from an industrial point of view.

We claim:

1. A high-strength cold-rolled steel strip or a molten zinc-plated high-strength cold-rolled steel strip which have a low yield strength, excellent work hardenability, excellent baking hardenability ≧3 kgf/mm², a WH amount of ≧4 kgf/mm², yield ratio of not more than 0.5.5, average r value not less than 1.6, and excellent formability, consisting essentially of, by weight, of 0.0005–0.01% C, not more than 0.8% Si, more than 0.5% but not more than 3.0% Mn, 0.01–0.12% P, 0.0010–0.015% S, 0.01–0.1% Al, 0.00050–0.0060% N, not less than 0.0001% but less than 0.0005% B, the contents of B and N being made to satisfy B/N ≦0.48, 0.005–0.1% Nb, the content of Nb being made to satisfy Nb ≧93/12 (C-0.0015), and the balance Fe and incidental impurities.

2. A high-strength cold-rolled steel strip or a molten zinc-plated high-strength cold-rolled steel strip according to claim 1, containing 0.2–3.0% Cr.

3. A high-strength cold-rolled steel strip or a molten zinc-plated high-strength cold-rolled steel strip which have a low yield strength, excellent work hardenability, excellent baking hardenability ≧3 kgf/mm², a WH amount of ≧4 kgf/mm², yield ratio of not more than 0.55, average r value not less than 1.6, and excellent formability, consisting essentially of, by weight, of 0.0005–0.01% C, more than 0.03% but not more than 0.8% Si, more than 0.5% but not more than 3.0% Mn, 0.01–0.12% P, 0.0010–0.015% S. 0.01–0.1% Al, 0.0005–0.0060% N, not less than 0.0001% but less than 0.0005% B, the contents of B and N being made to satisfy B/N ≦0.48, 0.005–0.1% Ti, 0.003–0.1% Nb, the content of Nb and the content of Ti being made to satisfy Ti ≧3.42N, and the balance Fe and incidental impurities.

4. A high-strength cold-rolled steel strip or a molten zinc-plated high-strength cold-rolled steel strip which have a low yield strength, excellent work hardenability, excellent baking hardenability ≧3 kgf/mm², a WH amount of ≧4 kgf/mm², yield ratio of not more than 0.55, average r value not less than 1.6, and excellent formability, consisting essentially of, by weight, of 0.0005–0.01% C, more than 0.3% but not more than 0.8% Si, more than 0.5% but not more than 3.0% Mn, 0.2–3.0% Cr, 0.01–0.12% P, 0.0010–0.015% S, 0.01–0.1% Al, 0.0005–0060% N, 0.005–0.1% Ti, 0.003–0.1% Nb, the content of Nb and the content of Ti being made to satisfy Ti ≧3.42N, and the balance Fe and incidental impurities.

5. A high-strength cold-rolled steel strip or a molten zinc-plated high-strength cold-rolled steel strip according to claim 4, containing 0.0001–0.0020% B.

6. A method of producing a high-strength cold-rolled steel strip characterized by the steps of finishing the hot-rolling of a slab, having baking hardenability ≧3 kgf/mm², a WH amount of ≧4 kgf/mm² and average r value not less than 1.6, yield ratio not more than 0.55 and, having a chemical composition consisting essentially of, by weight, 0.0005–0.01% C, not more than 0.8% Si, more than 0.5% but not more than 3.0% Mn, 0.01–0.12% P, 0.0010–0.015% S, 0.01–0.1% Al, 0.0005–0.0060% N, not less than 0.0001% but less than 0.0005% B, the contents of B and N being made to satisfy B/N ≦0.48, 0.005–0.1% Nb, the content of Nb being made to satisfy Nb ≧93/12 (C-0.0015), and the balance Fe and incidental impurities, at a temperature of not less than ($Ar_3$—100)° C.; taking it up at a temperature ranging from room temperature to 750° C.; cold-rolling it at a rolling rate of not less than 60%; and setting an annealing temperature during continuous annealing to 700°-900° C.

7. The method of claim 6 wherein said composition further contains 0.2-3.0% Cr.

8. A method of producing a high-strength cold-rolled steel strip characterized by the steps of finishing the hot-rolling of a slab, having baking hardenability ≧3 kgf/mm$^2$, a WH amount of ≧4 kgf/mm$^2$ and average r value not less than 1.6, yield ratio not more than 0.55 and, having a chemical composition consisting essentially of, by weight, 0.0005-0.01% C, more than 0.3% but not more than 0.8% Si, more than 0.5% but not more than 3.0% Mn, 0.01-0.12% P, 0.0010-0.015% S, 0.01-0.1% Al, 0.0005-0.0060% N, not less than 0.0001% but less than 0.0005% B, the contents of B and N being made to satisfy B/N ≦0.48, 0.005-0.1% Ti, 0,003-0.1% Nb, the content of Nb and the content of Ti being made to satisfy Ti ≧3.42N, and the balance Fe and incidental impurities, at a temperature of not less than ($Ar_3$—100)° C.; taking it up at a temperature ranging from room temperature to 750° C.: cold-rolling it at a rolling rate of not less than 60%; and setting an annealing temperature during continuous annealing to 700°-900° C.

9. A method of producing a high-strength cold-rolled steel strip characterized by the steps of finishing the hot-rolling of a slab, having baking hardenability ≧3 kgf/mm$^2$, a WH amount of ≧4 kgf/mm$^2$ and average r value not less than 1.6, yield ratio not more than 0.55 and, having a chemical composition consisting essentially of, by weight, 0.0005-0.01% C, more than 0.3% but not more than 0.8% Si, more than 0.5% but not more than 3.0% Mn, 0.2-3.0% Cr, 0.01-0.12% P, 0.0010-0.015% S, 0.01-0.1% Al, 0.0005-0.0060% N, 0.0005-0060% N, 0,005-0.1% Ti, 0,003-0.1% Nb, the content of Nb and the content of Ti being made to satisfy Ti ≧3.42N, and the balance Fe and incidental impurities, at a temperature of not less than ($Ar_3$—100)° C.; taking it up at a temperature ranging from room temperature to 750° C.; cold-rolling it at a rolling rate of not less than 60%; and setting an annealing temperature during continuous annealing to 700°-900° C.

10. The method of claim 9 wherein said composition further contains 0.0001-0.0020% B.

11. A method of producing a molten zinc-plated high-strength cold-rolled steel strip having excellent anti-powdering property, characterized by comprising the steps of finishing the hot-rolling of a slab, having baking hardenability ≧3 kgf/mm$^2$, a WH amount of ≧4 kgf/mm$^2$ and average r value not less than 1.6, yield ratio not more than 0.55 and, having a chemical composition consisting essentially of, by weight, 0.0005-0.01% C, not more than 0.8% Si, more than 0.5% but not more than 3.0% Mn, 0.01-0.12% P, 0.0010-0.015% S, 0.01-0.1% Al, 0.0005-0.0060% N, not less than 0.0001% but less than 0.0005% B, the contents of B and N being made to satisfy B/N ≦0.48, 0.005-0.1% Nb, the content of Nb being made to satisfy Nb ≧93/12 (C-0.0015), and the balance Fe and incidental impurities, at a temperature of not less than ($Ar_3$—100)° C.; coiling it up at a temperature ranging from room temperature to 750° C.; cold-rolling it at a rolling rate of not less than 60%; and applying thereto molten zinc-plating of an in-line annealing at an annealing temperature of 700°-900° C.

12. The method of claim 11 wherein said composition further contains 0.2-3.0% Cr.

13. A method of producing a molten zinc-plated high-strength cold-rolled steel strip characterized by comprising the steps of finishing the hot-rolling of a slab, having baking hardenability ≧3 kgf/mm$^2$, a WH amount of ≧4 kgf/mm$^2$ and average r value not less than 1.6, yield ratio not more than 0.55 and, having a chemical composition consisting essentially of, by weight, 0.0005-0.01% C, not more than 0.8% Si, more than 0.5% but not more than 3.0% Mn, 0.01-0.12% P, 0.0010-0.015% S, 0.01-0.1% Al, 0.0005-0.0060% N, not less than 0.0001% but less than 0.0005% B, the contents of B and N being made to satisfy B/N ≦0.48, 0.005-0.1% Nb, the content of Nb being made to satisfy Nb ≧93/12 (C-0.0015), and the balance Fe and incidental impurities, at a temperature of not less than ($Ar_3$—100)° C.; coiling it up at a temperature ranging from room temperature to 750° C.; cold-rolling it at a rolling rate of not less than 60%; and applying thereto molten zinc-plating of an in-line annealing at an annealing temperature of 700°-900° C.

14. A method of producing a molten zinc-plated high-strength cold-rolled steel strip characterized by comprising the steps of finishing the hot-rolling of a stab, having baking hardenability ≧3 kgf/mm$^2$, a WH amount of ≧4 kgf/mm$^2$ and average r value not less than 1.6, yield ratio run not more than 0.55 and, having a chemical composition consisting essentially of, by weight, 0.0005-0.01% C, not more than 0.8% Si, more than 0.5% but not more than 3.0% Mn, 0.01-0.12% P, 0.0010-0.015% S, 0.01-0.1% Al, 0.0005-0.0060% N, not less than 0.0001% but less than 0.0005% B, the contents of B and N being made to satisfy B/N ≦0.48, 0.005-0.1% Nb, the content of Nb being made to satisfy Nb ≧93/12(C-0.0015), and the balance Fe and incidental impurities, at a temperature of not less than ($Ar_3$—100)° C.; coiling it up at a temperature ranging from room temperature to 750° C.; cold-rolling it at a rolling rate of not less than 60%; and applying thereto molten zinc-plating of an in-line annealing at an annealing temperature of 700°-900° C.

15. The method of claim 14 wherein said composition further contains 0.001-0.0020% B.

* * * * *